US011511969B2

(12) United States Patent
Kattainen et al.

(10) Patent No.: US 11,511,969 B2
(45) Date of Patent: Nov. 29, 2022

(54) METHOD, AN ELEVATOR SAFETY CONTROL UNIT, AND AN ELEVATOR SYSTEM FOR DEFINING A CONDITION OF AN ELEVATOR CAR SUSPENSION MEANS

(71) Applicant: KONE Corporation, Helsinki (FI)

(72) Inventors: Ari Kattainen, Helsinki (FI); Petteri Valjus, Helsinki (FI); Erkka Kiviaho, Helsinki (FI); Andrew Jahn, Allen, TX (US)

(73) Assignee: KONE Corporation, Helsinki (FI)

( * ) Notice: Subject to any disclaimer, the term of this patent is extended or adjusted under 35 U.S.C. 154(b) by 393 days.

(21) Appl. No.: 16/832,568

(22) Filed: Mar. 27, 2020

(65) Prior Publication Data

US 2020/0223667 A1 Jul. 16, 2020

Related U.S. Application Data

(63) Continuation of application No. PCT/US2017/054022, filed on Sep. 28, 2017.

(51) Int. Cl.
*B66B 7/12* (2006.01)
*B66B 5/00* (2006.01)

(52) U.S. Cl.
CPC ..... *B66B 7/1215* (2013.01); *B66B 5/0031* (2013.01)

(58) Field of Classification Search
CPC ..... B66B 7/1215; B66B 5/0031; B66B 9/00; B66B 5/0037; B66B 5/0018; B66B 5/0025; B66B 7/1238; B66B 7/1223; B66B 5/12; B66B 1/3492; B66B 5/02; B66B 7/10; B66B 5/00; B66B 11/008; B66B 5/0006; B66B 3/002; B66B 5/0087; B66B 7/06; B66B 7/12; D07B 1/145; D07B 2301/259
See application file for complete search history.

(56) References Cited

U.S. PATENT DOCUMENTS 6,073,728 A * 6/2000 Olsen ..... B66B 7/123 73/158
2017/0022028 A1* 1/2017 Cortona ..... B66B 3/002

FOREIGN PATENT DOCUMENTS

| | | | | |
|---|---|---|---|---|
| CN | 106660741 | A | 5/2017 | |
| DE | 11 2015 003 122 | T5 | 3/2017 | |
| JP | 5-262474 | A | 10/1993 | |
| JP | 6-144744 | A | 5/1994 | |
| JP | 2012-171776 | A | 9/2012 | |
| JP | 2012171776 | A * | 9/2012 | |
| WO | WO-2016002370 | A1 * | 1/2016 | ..... B66B 7/022 |

* cited by examiner

*Primary Examiner* — Yoshihisa Ishizuka
*Assistant Examiner* — Carter W Ferrell
(74) *Attorney, Agent, or Firm* — Birch, Stewart, Kolasch & Birch, LLP

(57) ABSTRACT

The invention relates to a method for defining a condition of an elevator car suspension means. The method includes detecting a rate of change of elongation of the elevator car suspension means in order to define the condition of the elevator car suspension means. The invention relates also to an elevator safety control unit and an elevator system performing at least partly the method.

3 Claims, 8 Drawing Sheets

METHOD, AN ELEVATOR SAFETY CONTROL UNIT, AND AN ELEVATOR SYSTEM FOR DEFINING A CONDITION OF AN ELEVATOR CAR SUSPENSION MEANS

CROSS REFERENCE TO RELATED APPLICATIONS

This application is a Continuation of PCT International Application No. PCT/US2017/054022, filed on Sep. 28, 2017, which is hereby expressly incorporated by reference into the present application.

TECHNICAL FIELD

The invention concerns in general the technical field of elevators. Especially the invention concerns safety of elevators.

BACKGROUND

Elevators comprise suspension means, such as a rope or a belt, for carrying an elevator car. Traditionally, steel ropes have been used as the elevator ropes. Typically, the ropes or belts elongates during the use of the elevator. The elongation is a result from a normal wear, fatigue etc. The elongation of the ropes or belts causes that the condition of the ropes or belts deteriorates during the use of the elevator. Thus, at some point the elongated ropes or belts needs to be replaced. If the elongated rope or belt is not replaced, there will be a potential risk of a serious accident.

Typically, condition, such as deterioration or ending of the lifetime, of the steel ropes has been recognized visually in situ for example by counting wire breaks of the rope, by measuring a diameter of the rope, by measuring rust output from the rope, and/or by measuring the size of the wear lenses of the wires of the rope. However, if the steel ropes are coated for example with a polyurethane coating, the traditional recognition methods may not be used or the traditional recognition methods are not reliable. For example, the wire breaks of the rope may remain hidden under the coating. Furthermore, nowadays the manual recognition methods should be replaced with automated method in order to enhance the safety of the elevators.

Furthermore, according to some prior art solutions the condition of the suspension means may be defined or monitored by measuring the electrical resistance of the suspension means, determining the stiffness of the suspension means, or by ac voltage measurements.

Thus, there is a need for further development of the recognition methods of condition of the elevator suspension means, such as ropes or belts.

SUMMARY

An objective of the invention is to present a method, an elevator safety control unit, and an elevator system for defining a condition of an elevator car suspension means. Another objective of the invention is that the method, the elevator safety control unit, and the elevator system for defining a condition of an elevator car suspension means improve at least partly the safety of the elevators.

The objectives of the invention are reached by a method, an elevator safety control unit, and an elevator system as defined by the respective independent claims.

According to a first aspect a method for defining a condition of an elevator car suspension means is provided, wherein the method comprises detecting a rate of change of elongation of the elevator car suspension means in order to define the condition of the elevator car suspension means.

The method may comprise: obtaining periodically a value representing the elongation of the elevator car suspension means; defining a change value representing a rate of change of the elongation of the elevator car suspension means as a function of time based on the periodically obtained values representing the elongation of the elevator car suspension means; and generating, in response to a detection that the change value meets a limit for allowed change, an indication representing a change of the condition of the elevator car suspension means.

The limit for the allowed change may be defined based on previously defined change values.

The value representing the elongation of the elevator car suspension means may be one of the following: an overtravel distance of the elevator car, a distance between the elevator car and a counterweight along the elevator car suspension means, a position of the counterweight.

The change value representing the rate of change of the elongation of the elevator car suspension means may be one of the following: rate of change of the elongation of the elevator car suspension means, change of an overtravel distance of the elevator car, change of a distance between the elevator car and a counterweight along the elevator car suspension means, change in a position of the counterweight.

Furthermore, the indication may comprise an instruction to take the elevator car out of service and/or to replace the elevator car suspension means with a new elevator car suspension means.

According to a second aspect, an elevator safety control unit for defining a condition of an elevator car suspension means is provided, the elevator safety control unit comprising: at least one processor, and at least one memory storing at least one portion of computer program code, wherein the at least one processor being configured to cause the elevator safety control unit at least to detect a rate of change of elongation of the elevator car suspension means in order to define the condition of the elevator car suspension means.

The elevator safety control unit may be configured to: obtain periodically a value representing the elongation of the elevator car suspension means; define a change value representing a rate of change of the elongation of the elevator car suspension means as a function of time based on the periodically obtained values representing the elongation of the elevator car suspension means; and generate, in response to a detection that the change value meets a limit for allowed change, an indication representing a change of the condition of the elevator car suspension means.

The limit for the allowed change may be defined based on previously defined change values.

The value representing the elongation of the elevator car suspension means may be one of the following: an overtravel distance of the elevator car, a distance between the elevator car and a counterweight along the elevator car suspension means, a position of the counterweight.

The change value representing the rate of change of the elongation of the elevator car suspension means may be one of the following: rate of change of the elongation of the elevator car suspension means, change of an overtravel distance of the elevator car, change of a distance between the elevator car and a counterweight along the elevator car suspension means, change in a position of the counterweight.

Furthermore, the indication may comprise an instruction to take the elevator car out of service and/or to replace the elevator car suspension means with a new elevator car suspension means.

According to a third aspect, an elevator system for defining a condition of an elevator car suspension means is provided, wherein the elevator system comprising: an elevator car, an elevator suspension means for carrying the elevator car, and an elevator safety control unit, wherein the safety control unit is configured to detect a rate of change of elongation of the elevator car suspension means in order to define the condition of the elevator car suspension means.

The elevator system may further comprise an elevator service unit, wherein the elevator safety control unit may be configured to: obtain periodically a value representing the elongation of the elevator car suspension means, and wherein the elevator safety control unit or the elevator service unit may be configured to: define a change value representing a rate of change of the elongation of the elevator car suspension means as a function of time based on the periodically obtained values representing the elongation of the elevator car suspension means; and generate, in response to a detection that the change value meets a limit for allowed change, an indication representing a change of the condition of the elevator car suspension means.

Alternatively, the elevator system may further comprise an elevator service unit, wherein the elevator safety control unit may be configured to: obtain periodically a value representing the elongation of the elevator car suspension means, and define a change value representing a rate of change of the elongation of the elevator car suspension means as a function of time based on the periodically obtained values representing the elongation of the elevator car suspension means; and wherein the elevator service unit may configured to: generate, in response to a detection that the change value meets a limit for allowed change, an indication representing a change of the condition of the elevator car suspension means.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
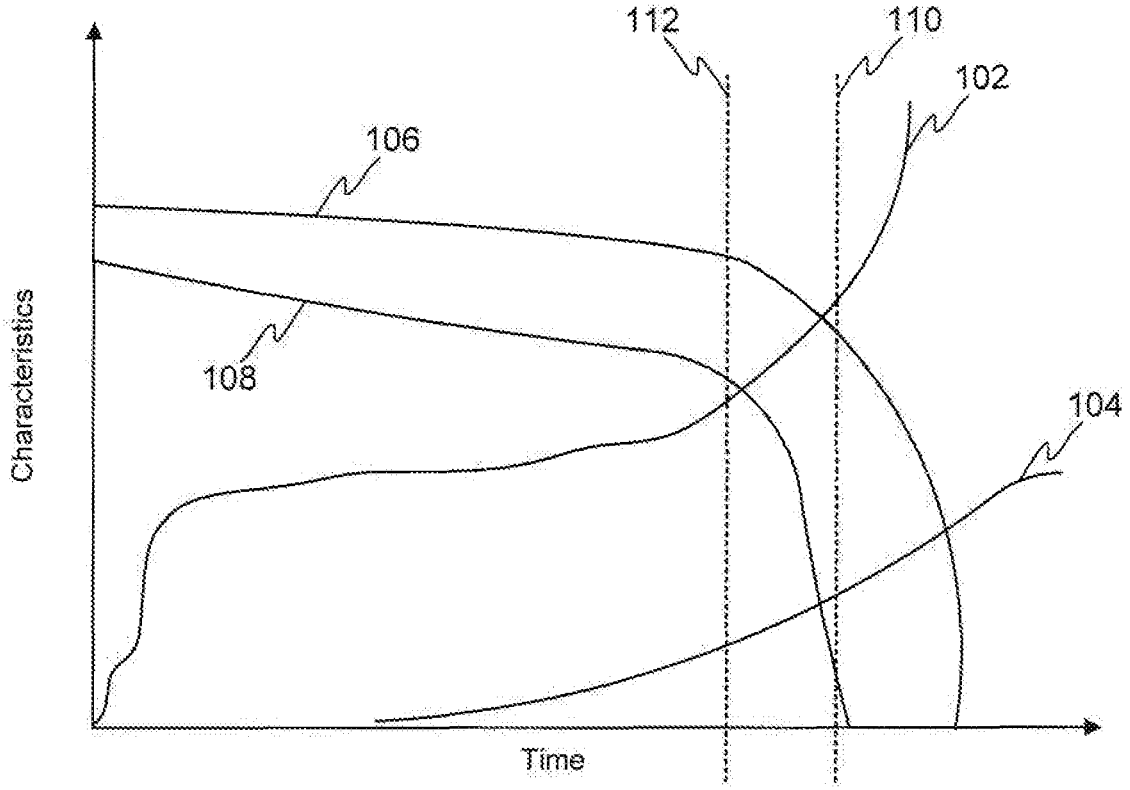
FIG. 1 illustrates schematically an example of different characteristics of an elevator car suspension means during its lifetime.

FIG. 1 illustrates schematically an example of different characteristics of an elevator car suspension means 210, such as a rope or a belt, during its lifetime. The x-axis in FIG. 1 represents time and the y-axis represents the change of the different characteristics of the elevator car suspension means 210. The line 102 represents elongation of the elevator car suspension means 210, i.e. the length increase of the elevator car suspension means 210 over the time under constant force. The line 104 represents the amount of wire breaks of the elevator car suspension means 210. The line 106 represents the elevator car suspension means 210 breaking load (RBL). The line 108 represents the diameter of the elevator car suspension means 210. Typically, the elevator car suspension means 210 elongate strongly, when they are new. After that the elongation stabilizes and remains substantially small until the lifetime of the elevator car suspension means 210 approaches to the end and the elongation of the rope or belt starts to increase again. This means that the elevator car suspension means 210 has reached the point of rapid degradation as a result of wear, fatigue, and inner undetected wire breaks, etc. When the elongation starts to increase again, the RBL starts to decrease significantly. This point is illustrated in FIG. 1 with the line 110. At the latest at this point, the elevator should be taken out of service and/or the elevator car suspension means 210 should be replaced with a new rope or belt. Preferably, the elevator car suspension means 210 should be replaced with a new the elevator car suspension means 210 already before the elongation starts to increase. This point is illustrated in FIG. 1 with the line 112.

Figure 2:
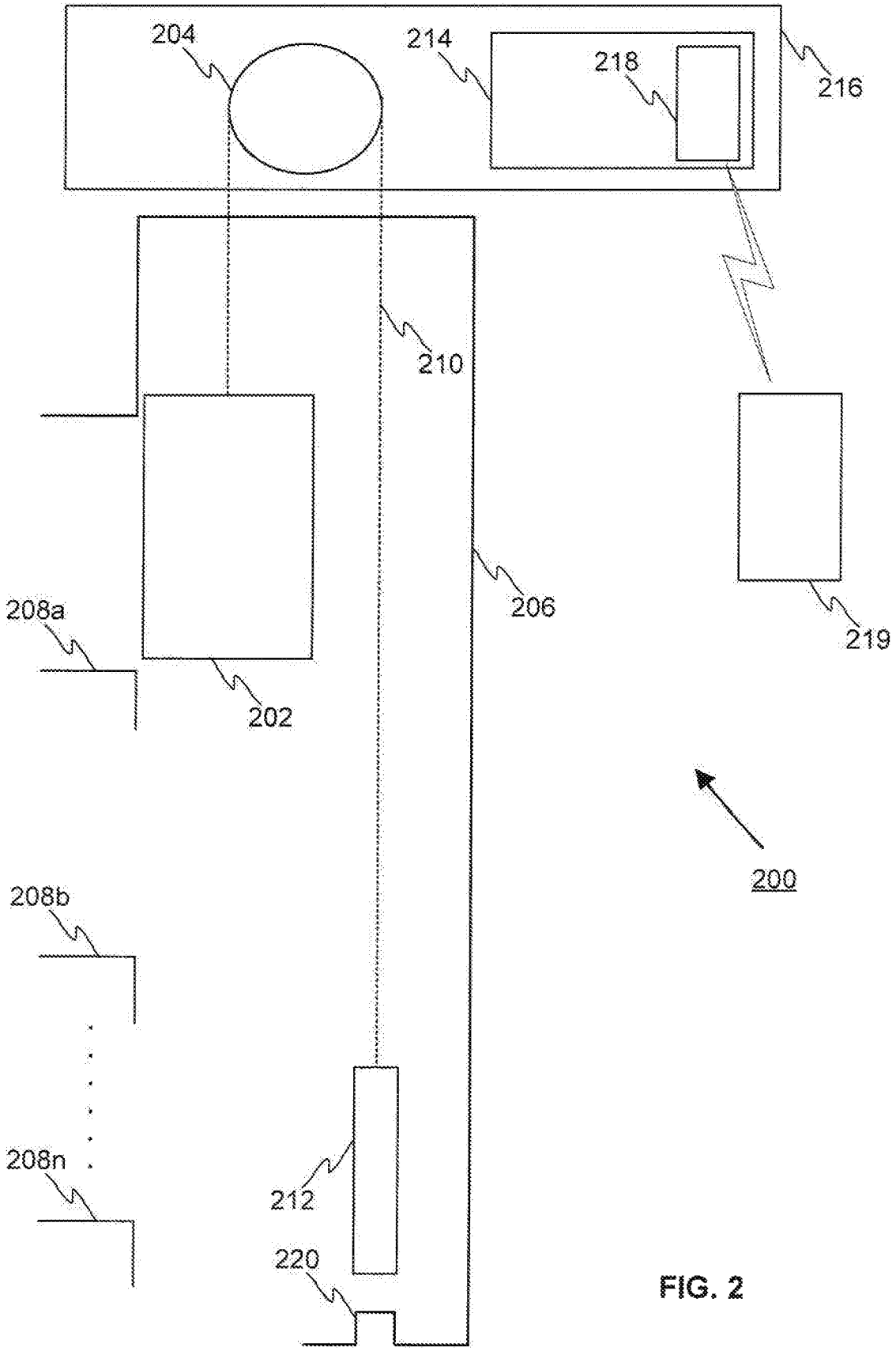
FIG. 2 illustrates schematically an example of an elevator system according to the invention.

FIG. 2 illustrates schematically an example of an elevator system 200 according to the invention, wherein the embodiments of the invention may be implemented as will be described. The elevator system 200 may comprise an elevator car 202 and a hoisting machine 204 configured to drive the elevator 202 car in an elevator shaft 206 between floors 208*a*-208*n*, i.e. landings. Furthermore, the elevator system may comprise suspension means 210 for carrying, i.e. suspending, the elevator car 202. The suspension means 210 may be at least one of the following: rope, belt. A belt may comprise a plurality of ropes travelling inside the belt. Furthermore, the ropes may be coated for example with a polyurethane coating. In order to carry, suspend, the elevator car 202 the elevator suspension means 210 may be arranged to pass from the elevator car 202 over a pulley of the hoisting machine 104 to a counterweight 212. The elevator car 202 may be arranged to one end of the elevator car suspension means 210 and the counterweight 212 may be arranged to the other end of the elevator car suspension means 210. Alternatively, the elevator car 202 and the counterweight 212 may be suspended with the elevator car suspension means 210 by means of one or more diverter pulleys. The counterweight 212 may be a metal tank with a ballast of weight approximately 40-50 percent of the weight of a fully loaded elevator car 202.

The elevator system 200 according to the invention may further comprise an elevator control unit 214 that may be configured to control the operation of the elevator system 200. The elevator control unit 214 may reside in a machine room 216. According to one embodiment a safety control unit 218 according to the invention may be implemented as a part of the elevator control unit 214 as illustrated in FIG. 2. According to another embodiment the safety control unit 218 may be implemented as a separate unit.

The elevator system 200 according to the invention may further comprise an external elevator service unit 219 that may be communicatively coupled to the elevator safety control unit 218. The communication between the elevator safety control unit 218 and the elevator service unit 219 may be based on one or more known communication technologies, either wired or wireless. The elevator service unit 219 may be for example a service center, service company or similar.

The method according to the invention enables defining a condition of the elevator car suspension means 210 by detecting a rate of change of elongation of the elevator car suspension means 210. The method according to the invention comprises detecting the rate of change of elongation of the elevator car suspension means 210 in order to define the condition of the elevator car suspension means 210, wherein the condition of the elevator suspension means 210 may be for example ending of the lifetime.

Figure 3:
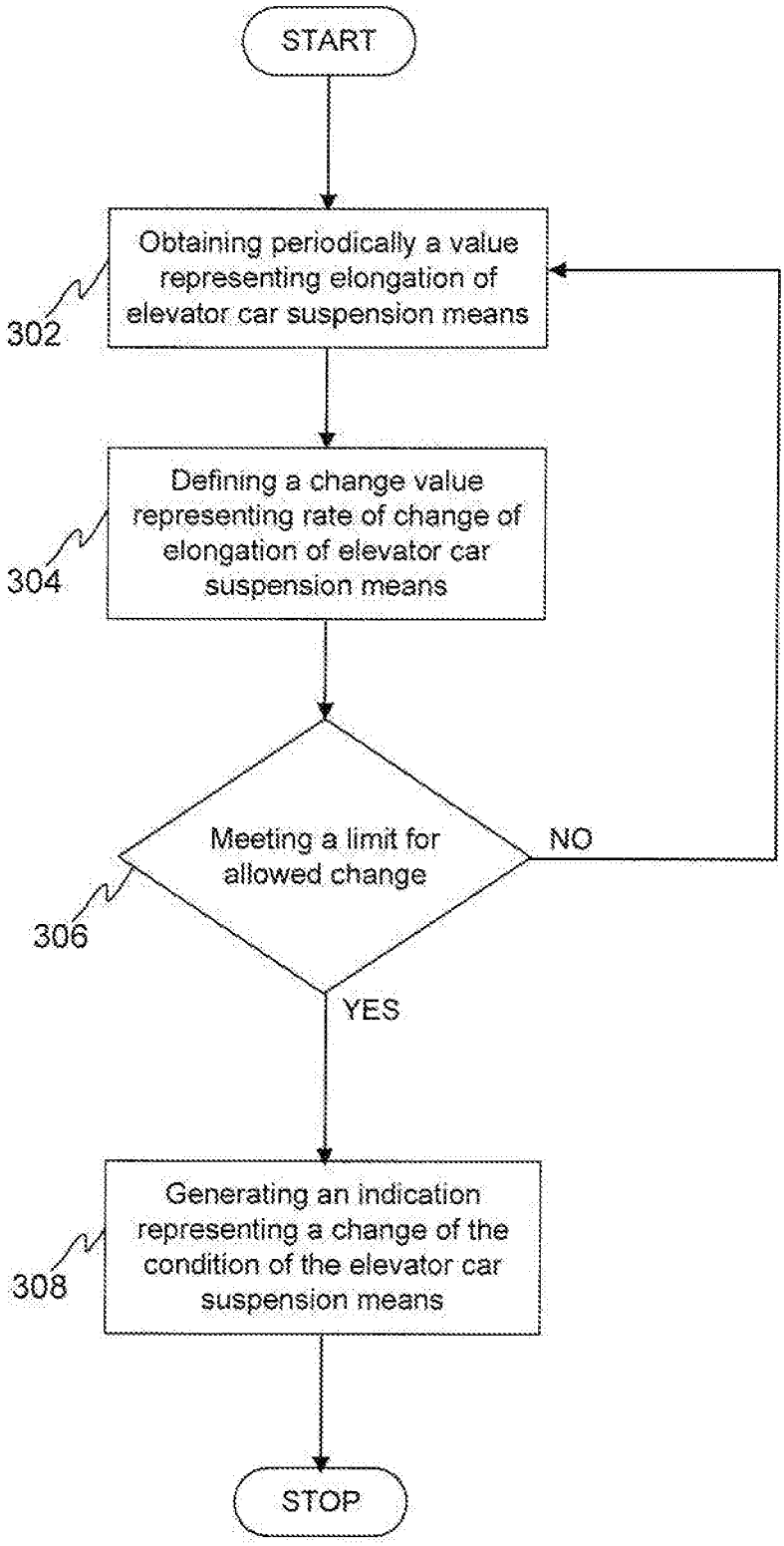
FIG. 3 illustrates schematically an example of a method according to the invention.

Next an example of a method according to the invention is described by referring to FIG. 3. FIG. 3 schematically illustrates the invention as a flow chart. The elevator safety control unit 218 obtains 302 periodically a value representing the elongation of the elevator car suspension means 210. The value representing the elongation of the elevator car suspension means 210 may be obtained at any regular or irregular time interval, for example once a day or once a week. The value representing the elongation of the elevator car suspension means 210 may be one of the following: an overtravel distance of the elevator car 202, a distance between the elevator car 202 and the counterweight 212 along the elevator suspension means 210, a position of the counterweight 212. Next the elevator safety unit 218 defines 304 a change value representing the rate of change of the elongation of the elevator car suspension means 210 as a function of time based on the periodically obtained values representing the elongation of the elevator car suspension means 210. The change value representing the rate of change of the elongation of the elevator car suspension means 210 may be one at least one of the following: rate of change of the elongation of the elevator car suspension means, change of an overtravel distance of the elevator car 202, change of a distance between the elevator car 202 and a counterweight 212 along the elevator suspension means 210, change of the position of the counterweight 212. In response to a detection 306 that the change value meets a limit for allowed change the elevator control unit 218 may generate 308 an indication representing a change of the condition of the elevator car suspension means 210.

The limit for the allowed change may be defined based on previously defined change values, i.e. a history data defined based on the periodically obtained values representing the elongation of the elevator car suspension means 210. After a strong elongation of the elevator car suspension means 210 (when they are new) the rate of change of the elongation of the elevator car suspension means 210 stabilizes and remains substantially steady. Then rate of change of the elongation of the elevator car suspension means 210 is substantially small and substantially constant. Thus, the limit for the allowed change may be defined to be the substantially constant rate of change of the elongation of the elevator car suspension means 210, when rate of change of the elongation of the elevator car suspension means 210 is stable and steady. Alternatively or in addition, the limit for the allowed change may be the constant rate of change of the elongation of the elevator car suspension means 210, when the change of the overtravel distance is stable and steady, added with a margin of error. When the rate of change of the elongation of the elevator car suspension means 210 starts to increase again, it is an indication that the condition of the elevator car suspension means 210 has changed, i.e. the lifetime of the elevator car suspension means 210 has ended.

Above it is described that the elevator safety control unit 218 performs all the method steps 302-308. Alternatively, the elevator safety control unit 218 may communicate the obtained values representing the elongation of the elevator car suspension means 210 to the elevator service unit 219. The elevator service unit 219 may then perform the method steps 304-308, namely definition 304 of the change value and generation 308 of the indication in response to the detection 306 that the change value meets the limit for allowed change. Alternatively or in addition, the elevator safety control unit 218 may perform the method steps 302 and 304 and the defined change value representing the rate of change of the elongation of the elevator car suspension means 210 may be communicated to the elevator service unit 219. After that the elevator service unit 219 may perform for example the method steps 306 and 308.

The communication between the elevator safety control unit 218 and the elevator service unit 219 may be continuous, i.e. real-time communication. Alternatively or in addition, the data, i.e. obtained values representing the elongation of the elevator car suspension means 210 and/or defined change values, may be communicated from the elevator safety control unit 218 to the elevator service unit 219 according to a predefined time scheme. The communication of the data according to the predefined time scheme means that the data is not communicated continuously or in real-time. Instead the data may be communicated at a time instant, which the elevator safety control unit 218 or the elevator service unit 219 defines to be suitable for the communication. The suitable time instant may be for example one of the following: regular time interval, irregular time interval, when no data memory of the elevator safety control unit 218 is full or almost full.

According to one embodiment of the invention the rate of change of the elongation of the elevator car suspension means may be detected by observing an overtravel distance of the elevator car, i.e. the obtained value representing the elongation of the elevator suspension means 210 is the overtravel distance of the elevator car.

When the elevator system is installed or the elevator car suspension means 210 are replaced with new elevator car suspension means 210, the length of the elevator car suspension means 210 is adjusted so that when the elevator car 202 is at the top floor 208*a*, the counterweight 212 is configured to be a predefined overtravel distance, i.e. an initial value for the overtravel distance, from a buffer 220 of the counterweight 212 arranged at the bottom of the elevator shaft 206. The predefined overtravel distance may be defined so that the predefined overtravel distance is more than an operating distance of a final limit switch, i.e. a distance between the operating point of the final limit switch and the roof level of the top floor 208*a*. The elevator system 200 may comprise the final limit switch arranged to the elevator shaft within a door zone above the top floor 208*a*. The final limit switch is configured to stop the movement of the elevator car 202 in either direction, if the elevator car 202 reaches the operating point of the final limit switch. Furthermore, the operating distance of the final limit switch may be preferably defined to be as short as possible, but the final limit switch may not be arranged too close to the roof level of the top floor so that the movement of the elevator car 202 is not stopped too easily, because it may reduce the availability of the elevators.

During the use of the elevator the elevator suspension means 210 elongates, which in turn causes that the overtravel distance decreases. Next one example for obtaining a value representing the overtravel distance is described. First the elevator car 202 that is empty is driven to the top floor 208*a* and the elevator is taken out of the normal operation. Next the elevator car 202 is driven upwards with a reduced speed until the counterweight 212 reaches the buffer 220. The reduced speed may be for example less than 0.25 m/s. A detection of a change in a torque of a hoisting motor indicates that the counterweight 212 reaches the buffer 220. The overtravel distance corresponds to the distance travelled by the elevator car 202 upwards from the top floor 208*a* up to the detection of the change in the torque of the hoisting motor indicating that the counterweight 212 comes into a contact with the buffer 220. The overtravel distance may be obtained for example with the elevator safety control unit 218. After obtaining the overtravel distance, the elevator car 202 is driven back to the top floor 208*a* and the elevator is returned back to the normal operation. The above described example is non-limiting example and the present invention is not limited to that. Thus, the overtravel distance may be obtained also by any other way.

Figure 4:
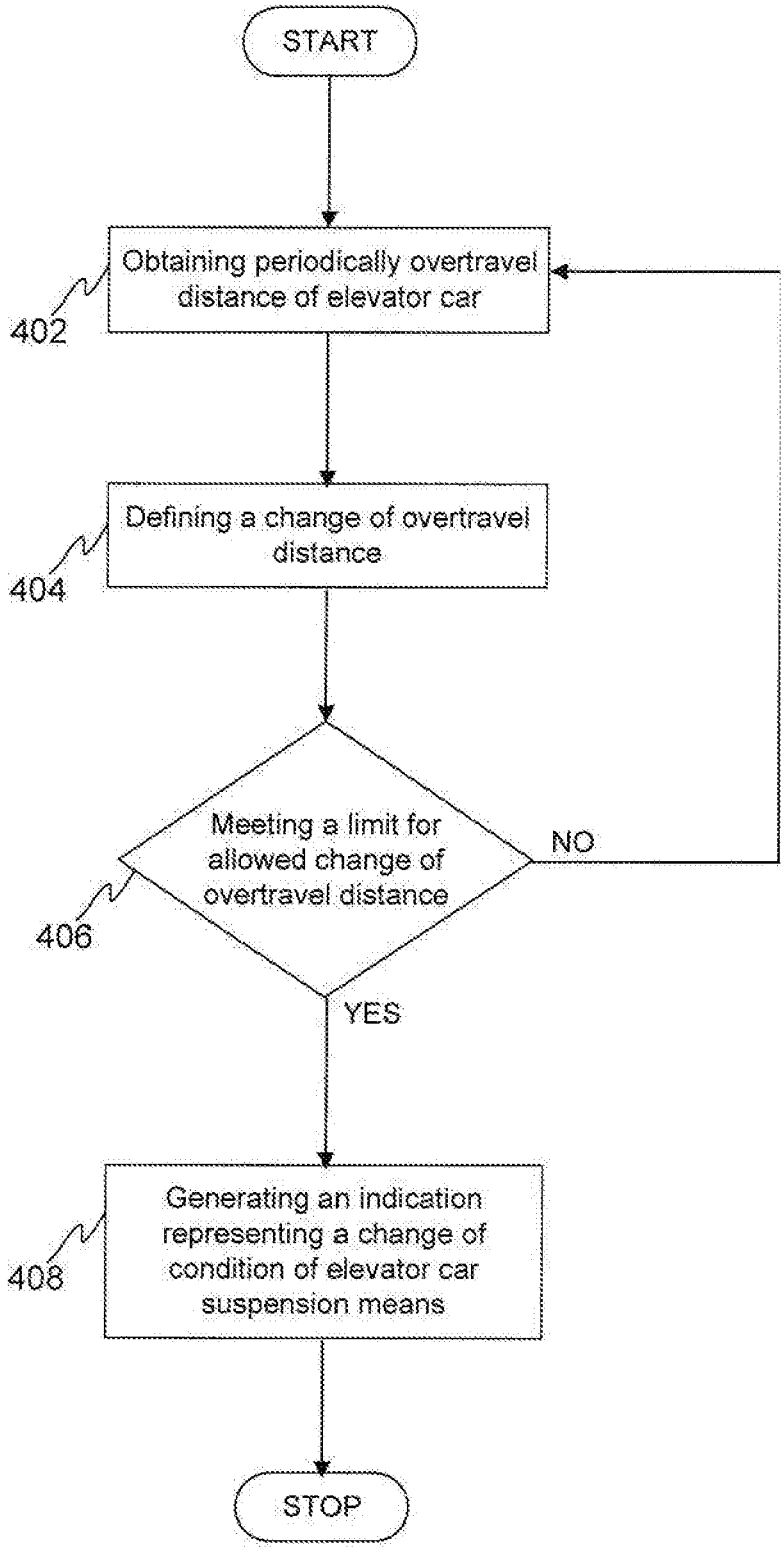
FIG. 4 illustrates schematically another example of the method according to the invention.

Next an example of detecting the rate of change of the elongation of the elevator car suspension means by observing the overtravel distance of the elevator car is described by referring to FIG. 4. FIG. 4 schematically illustrates the invention as a flow chart. The elevator safety control unit 218 obtains 402 periodically a value representing the elongation of the elevator car suspension means 210, wherein the value is the overtravel distance of the elevator car 202. The overtravel distance may be obtained as described above. The overtravel distance of the elevator car 202 may be obtained at any regular or irregular time interval, for example once a day or once a week. The elevator safety control unit 218 defines 404 a change value representing the rate of change of the elongation of the elevator car suspension means 210 as a function of time based on the periodically obtained the overtravel distances, wherein the change value is a change of the overtravel distance. In response to a detection 406 that the change of the overtravel distance meets a limit for allowed change of the overtravel distance the elevator safety control unit 218 generates 408 an indication representing a change of the condition of the elevator car suspension means 210. The change of the condition of the elevator car suspension means 210 may represent that the lifetime of the elevator car suspension means 210 is facing the end.

Figure 5:
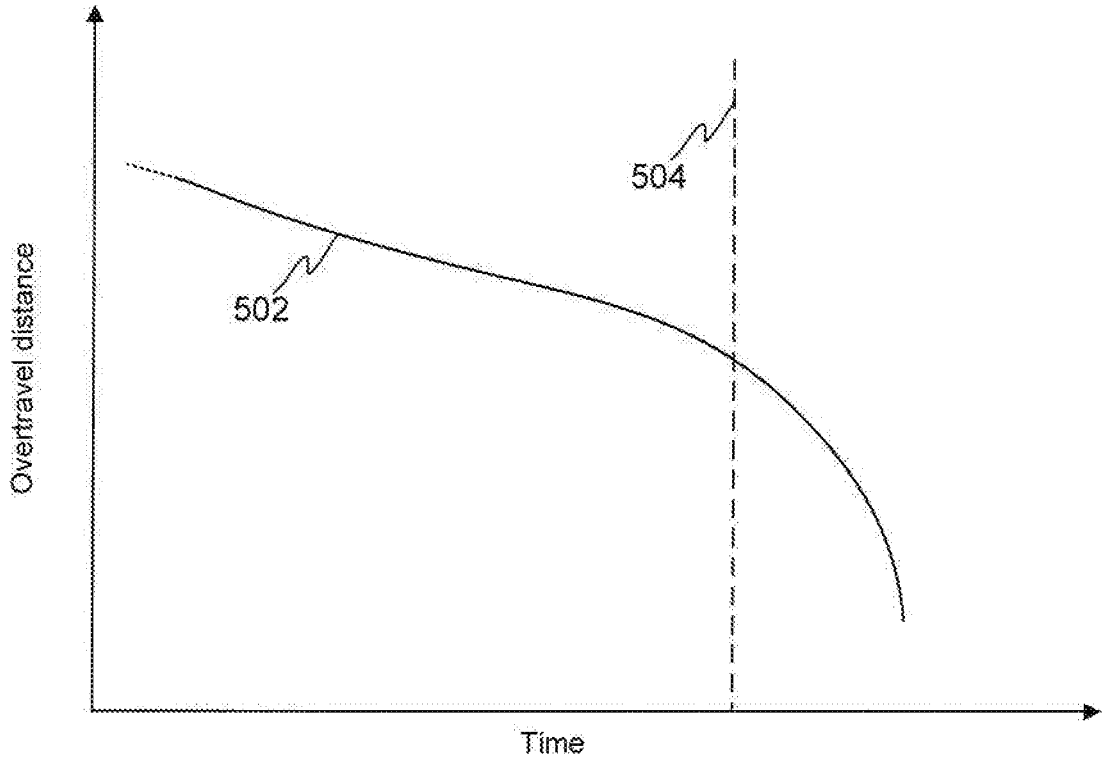
FIG. 5 illustrates schematically an example of obtained overtravel distance of an elevator car as a function of time.

The limit for the allowed change of the overtravel distance may be defined based on previously defined change of the overtravel distance, i.e. a history data defined based on the periodically obtained values representing the overtravel distance of the elevator car 202. FIG. 5 illustrates schematically the obtained overtravel distance of the elevator car 202 as a function of time (curve with reference number 502). After a strong elongation of the elevator car suspension means 210 (when they are new) the rate of change of the elongation of the elevator car suspension means 210 stabilizes and remains substantially steady. Similarly the change of the overtravel distance stabilizes and remains substantially steady. The strong elongation of the elevator car suspension means 210, when they are new, is not illustrated in FIG. 5 for clarity reasons. The limit for the allowed change of the overtravel distance may be defined based on the change of the overtravel distance, when the change of the overtravel distance is stable and steady. Then the change of the overtravel distance is substantially small and substantially constant. Thus, the limit for the allowed change of the overtravel distance may be defined to be the substantially constant change of the overtravel distance, when the change of the overtravel distance is stable and steady. Alternatively or in addition, the limit for the allowed change of the overtravel distance may be the constant change of the overtravel distance, when the change of the overtravel distance is stable and steady, added with a margin of error.

When the rate of change of the elongation of the elevator car suspension means 210 starts to increase again, the overtravel distance starts to decrease steeper than previously obtained overtravel distance, i.e. the slope of the curve 402 starts to increase, which is an indication that the condition of the elevator car suspension means 210 has changed, i.e. the lifetime of the elevator car suspension means 210 has ended. This point is illustrated in FIG. 5 with the line 504. Thus, the detection that the change of the overtravel distance meets the limit for allowed change of the overtravel distance indicates that the rate of change of the elongation of the elevator car suspension means 210 starts to increase, which in turn means that the condition of the elevator car suspension means 210 has changed.

As described above the elevator safety control unit 218 may perform all the method steps 402-408. Alternatively, the elevator safety control unit 218 may communicate the periodically obtained overtravel distances to the elevator service unit 219 and the elevator service unit 219 may perform the of the method steps 404-408, namely definition 404 of the change of the overtravel distance and generation 408 of the indication in response to the detection 406 that the change value meets the limit for allowed change. Alternatively or in addition, the elevator safety control unit 218 may perform the method steps 402 and 404 and the defined change value representing the rate of change of the elongation of the elevator car suspension means 210 may be communicated to the elevator service unit 219. After that the elevator service unit 219 may perform for example the method steps 406 and 408.

Figure 6:
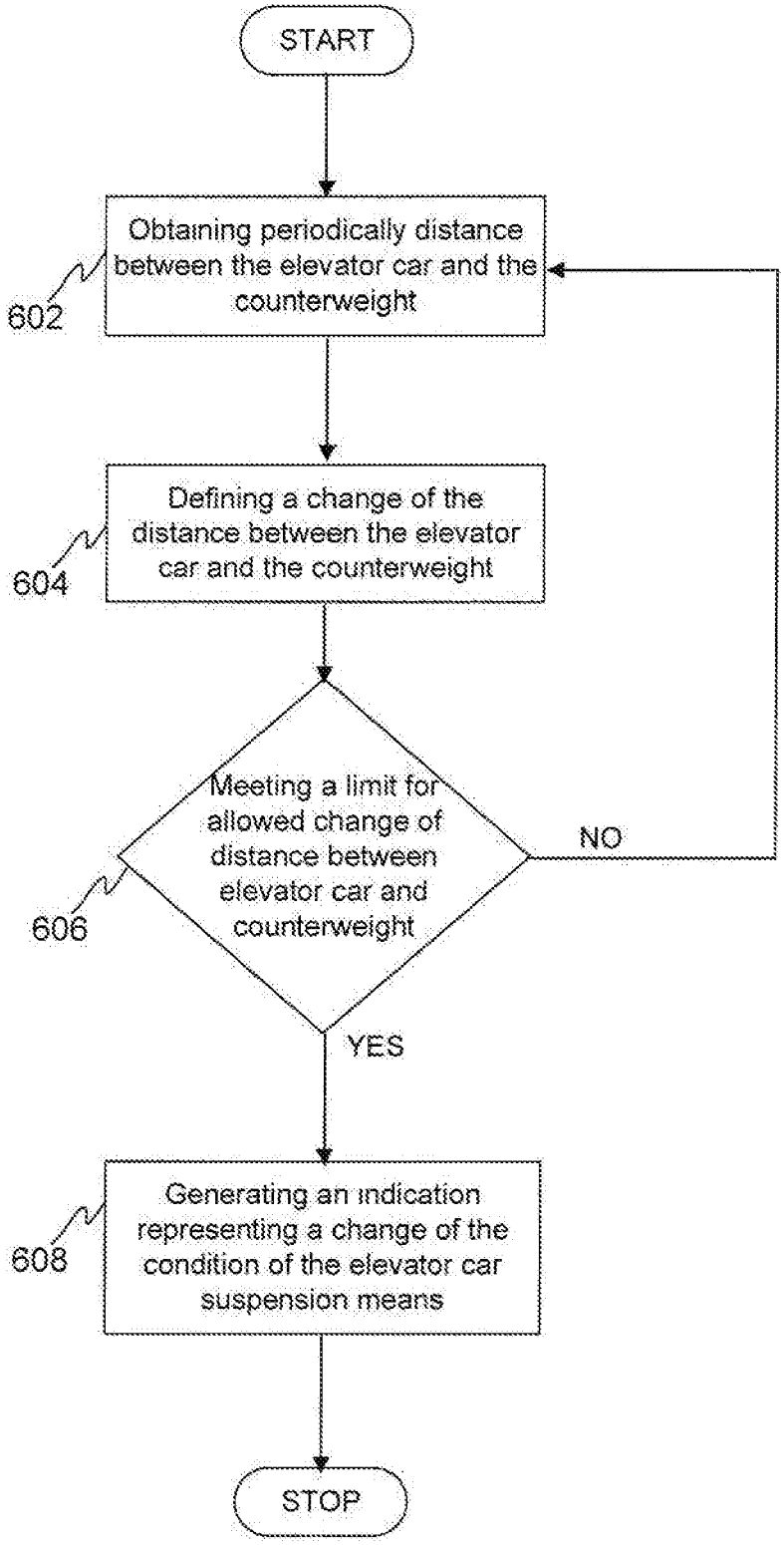
FIG. 6 illustrates schematically another example of the method according to the invention.

According to another embodiment of the invention the rate of change of the elongation of the elevator car suspension means 210 may be detected by observing a distance between the elevator car 202 and the counterweight 212 along the elevator suspension means 210. Next this embodiment is described by referring to FIG. 6. FIG. 6 schematically illustrates the invention as a flow chart. The safety control unit 218 obtains 602 periodically a value representing the elongation of the elevator car suspension means, wherein the value is a distance between the elevator car 202 and a counterweight 212 along the elevator suspension means 210. The distance between the elevator car 202 and the counterweight 212 along the elevator suspension means 210 may be defined by obtaining simultaneously position information of the elevator car 202 and position information of the counterweight 212. The position information of the elevator car 202 and the position information of the counterweight 212 may be defined for example during a quiet time, such as night time. The position information of the counterweight 212 may be obtained by driving the counterweight 212 to the buffer or a switch 220 arranged at a known position at the bottom of the elevator shaft 206. When the counterweight 212 is run to the buffer or to the switch 220 the position of the counterweight 212 may be defined based on the known position of the buffer or switch 220. At the same time the position information of the elevator car 202 may be obtained from a position sensor providing an absolute position of the elevator car 202 within the door zone. For example, the position information of the elevator car 202 may be obtained from at least one position sensor arranged to the elevator car 202, for example on the roof of the elevator car 202. The position sensor may be for example a magnetic sensor, such as a Hall sensor. The distance between the elevator car 202 and the counterweight 212 along the elevator suspension means 210 may be obtained at any regular or irregular time interval, for example once a day or once a week.

The safety control unit 218 defines 604 a change value representing the rate of change of the elongation of the elevator car suspension means as a function of time based on the periodically obtained the distances between the elevator car 202 and the counterweight 212, wherein the change value is a change of the distance between the elevator car 202 and a counterweight 212 along the elevator suspension means 210. In response to a detection 606 that the change of the distance between the elevator car 202 and the counterweight 212 along the elevator suspension means 210 meets a limit for allowed change of the distance between the elevator car 202 and the counterweight 212 the safety control unit 218 generates 608 an indication representing a change of the condition of the elevator car suspension means 210. The change of the condition of the elevator car suspension means 210 may represent that the lifetime of the elevator car suspension means 210 is facing the end.

The limit for allowed change of the distance between the elevator car 202 and the counterweight 212 along the elevator suspension means 210 may be defined based on previously defined change of the distance between the elevator car 202 and the counterweight 212 along the elevator suspension means 210. As described above after a strong elongation of the elevator car suspension means 210 (when they are new) the rate of change of the elongation of the elevator car suspension means 210 stabilizes and remains substantially steady. It means that the distance between the elevator car 202 and the counterweight along the elevator car suspension means 210 changes, i.e. increases, gradually and substantially constantly as the time passes because of the elongation of the elevator car suspension means 210. Thus the limit for allowed change of the distance between the elevator car 202 and the counterweight 212 along the elevator suspension means 210 may be defined to be the constant change of the distance between the elevator car 202 and the counterweight 212, when the change of the distance is substantially constant. Furthermore, the limit for the allowed change of the distance between the elevator car 202 and the counterweight 212 may be the constant change of the distance between the elevator car 202 and the counterweight 212 along the elevator suspension means 210, when the change of the distance is substantially constant, added with a margin of error.

When the rate of change of the elongation of the elevator car suspension means 210 starts to increase again, the distance between the elevator car 202 and the counterweight 212 along the elevator suspension means 210 starts to change, i.e. increase, more strongly than previously, which is an indication that the condition of the elevator car suspension means 210 has changed, i.e. the lifetime of the elevator car suspension means 210 has ended. Thus, the detection that the change of the distance between the elevator car 202 and the counterweight 212 along the elevator suspension means 210 meets the limit for allowed change of distance between the elevator car 202 and the counterweight 212 indicates that the rate of change of the elongation of the elevator car suspension means 210 starts to increase, which in turn means that the condition of the elevator car suspension means 210 has changed.

As describe above the elevator safety control unit 218 may perform all the method steps 602-608. Alternatively, the elevator safety control unit 218 may communicate the obtained position information of the elevator car 202 and counterweight 212 or the obtained distance between the elevator car and the counter weight 212 along the elevator suspension means 210 to the elevator service unit 219 and the elevator service unit 219 may perform the of the method steps 604-608, namely definition 604 of the change of the distance between the elevator car 202 and the counterweight 212 and generation 608 of the indication in response to the detection 606 that the change value meets a limit for allowed change. Alternatively or in addition, the elevator safety control unit 218 may perform the method steps 602 and 604 and the defined change value representing the rate of change of the elongation of the elevator car suspension means 210 may be communicated to the elevator service unit 219. After that the elevator service unit 219 may perform for example the method steps 606 and 608.

The above described embodiments of the present invention enable implementation of defining the condition of the elevator car suspension means by using already existing components of the elevator system 200.

Figure 7:
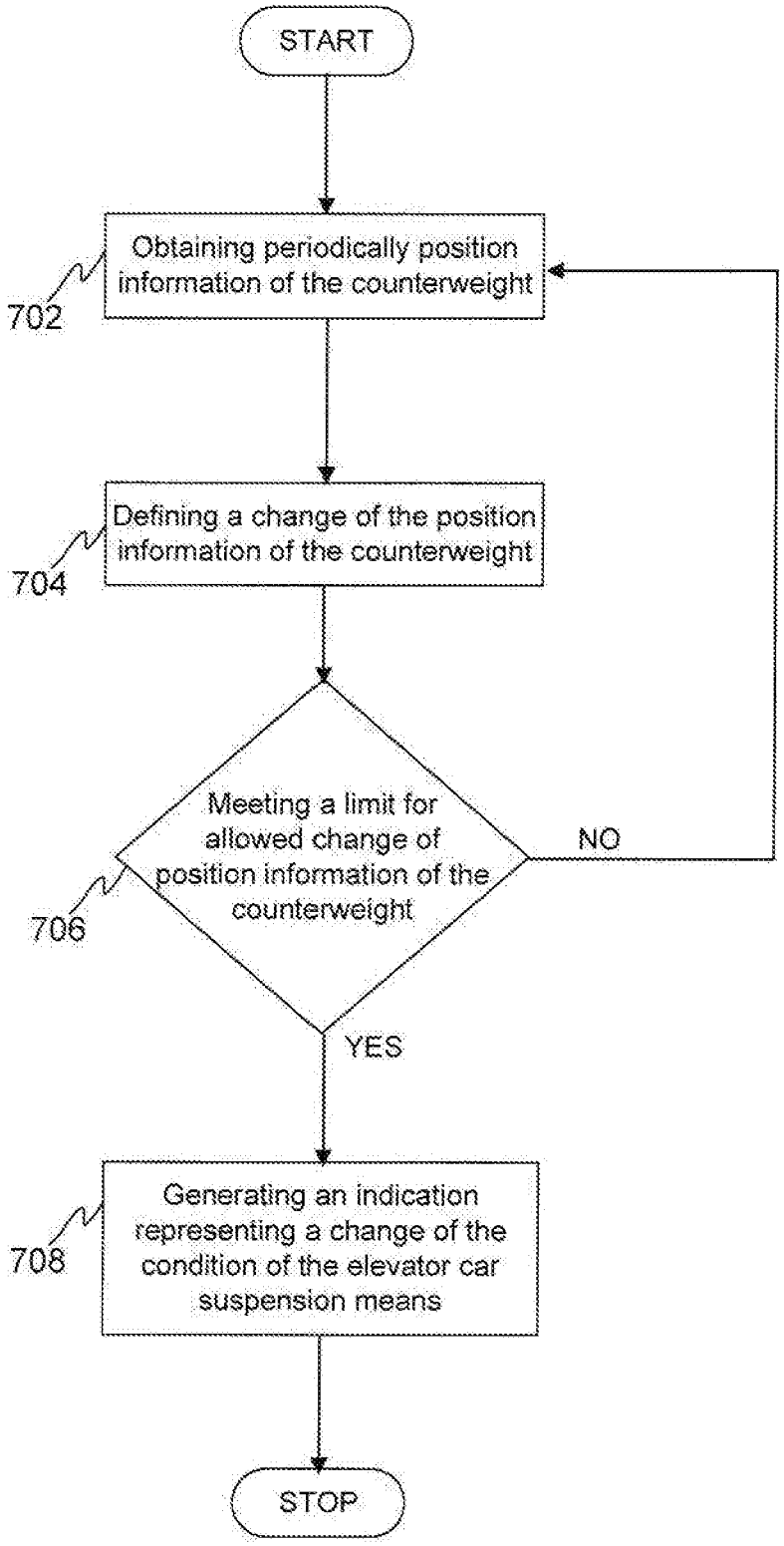
FIG. 7 illustrates schematically another example of the method according to the invention.

According to another embodiment of the invention the rate of change of the elongation of the elevator car suspension means 210 may be detected by observing a position of the counterweight 212. Next this embodiment is described by referring to FIG. 7. FIG. 7 schematically illustrates the invention as a flow chart. The safety control unit 218 obtains 702 periodically a value representing the elongation of the elevator car suspension means, wherein the value is position information of the counterweight 212. The position information of the counterweight 212 may be defined for example during a quiet time, such as night time. The position information of the counterweight 212 may be obtained for example by driving empty elevator car 202 to a known position inside the elevator shaft 206, for example to the top floor **208*a* or to the bottom floor 208*n*, and obtaining the position information of the counterweight 212 with a position sensor arranged to a corresponding position inside the elevator shaft 206. For example, if the elevator car 202 is driven to the bottom floor 208*n*, the position sensor may be arranged in the elevator shaft 206 at the top floor 208*a* so that the counterweight is in the operational vicinity of the position sensor. Because the counterweight 212 is heavier than the empty elevator car 202, the elevator car suspension means 210 elongates more, when the elevator car is at the top floor 208*a* and the counterweight 212 is in a contact with the buffer 220 arranged at the bottom of the elevator shaft 206, in comparison to a situation where the elevator car 202 is at the bottom floor 208*n* and the counterweight 212 at the top floor 208*a*. The longer elongation, in turn, enables that the definition of the elongation is easier and more reliable than when the elongation is smaller. The position sensor may provide a linear position of the counterweight 212 relative to a fixed reference position in the elevator shaft 206. The reference position may be an initial position of the counterweight 212, when the elevator system 200 is installed or the elevator car suspension means 210 are replaced with new elevator car suspension means 210. Thus, the change in the position of the counterweight 212 in relation to the fixed reference position represents the elongation of the elevator car suspension means 210**. The position sensor may be for example a magnetic sensor, such as a Hall sensor.

The safety control unit 218 defines 704 a change value representing the rate of change of the elongation of the elevator car suspension means 210 as a function of time based on the periodically obtained the positions of the counterweight 212, wherein the change value is a change of the position of the counterweight 212. In response to a detection 706 that the change of position of the counterweight 212 meets a limit for allowed change of the position of the counterweight 212, the safety control unit 218 generates 608 an indication representing a change of the condition of the elevator car suspension means 210. The change of the condition of the elevator car suspension means 210 may represent that the lifetime of the elevator car suspension means 210 is facing the end.

The limit for allowed change of the position of the counterweight 212 in relation to the fixed reference position may be defined based on previously defined change of the position of the counterweight 212 in relation to the fixed reference position. As described above after a strong elongation of the elevator car suspension means 210 (when they are new) the rate of change of the elongation of the elevator car suspension means 210 stabilizes and remains substantially steady. It means that the position of the counterweight 212 in relation to the fixed reference position changes, gradually and substantially constantly as the time passes because of the elongation of the elevator car suspension means 210. Thus, the limit for allowed change of position of the counterweight 212 in relation to the fixed reference position may be defined to be the constant change of the position of the counterweight 212 in relation to the fixed reference position, when the change of the position of the counterweight 212 in relation to the fixed reference position is substantially constant. Furthermore, the limit for the allowed change of the position of the counterweight 212 in relation to the fixed reference position may be the constant change of the position of the counterweight 212 in relation to the fixed reference position, when the change of the position of the counterweight 212 in relation to the fixed reference position is substantially constant, added with a margin of error.

When the rate of change of the elongation of the elevator car suspension means 210 starts to increase again, the position of the counterweight 212 in relation to the fixed reference position starts to change, more strongly than previously, which is an indication that the condition of the elevator car suspension means 210 has changed, i.e. the lifetime of the elevator car suspension means 210 has ended. Thus, the detection that the change of the position of the counterweight 212 in relation to the fixed reference position meets the limit for allowed change of the position of the counterweight 212 in relation to the fixed reference position indicates that the rate of change of the elongation of the elevator car suspension means 210 starts to increase, which in turn means that the condition of the elevator car suspension means 210 has changed.

As describe above the elevator safety control unit 218 may perform all the method steps 702-708. Alternatively, the elevator safety control unit 218 may communicate the obtained position information of the counterweight 212 to the elevator service unit 219 and the elevator service unit 219 may perform the of the method steps 704-708, namely definition 704 of the change of the position of the counterweight 212 in relation to the fixed reference position and generation 708 of the indication in response to the detection 706 that the change value meets a limit for allowed change. Alternatively or in addition, the elevator safety control unit 218 may perform the method steps 702 and 704 and the defined change value representing the rate of change of the elongation of the elevator car suspension means 210 may be communicated to the elevator service unit 219. After that the elevator service unit 219 may perform for example the method steps 706 and 708.

The indication generated at the steps 308, 408, 608, or 708 may comprise an instruction to take the elevator car 202 out of service and/or to replace the elevator car suspension means 210 with a new elevator car suspension means. The indication, such as a control signal, may be generated for the elevator control unit 214 in order to stop the operation of the elevator. Furthermore, the elevator car 202 may be instructed to stop at the nearest floor 208*a*-208*n* and to leave doors open. Alternatively or in addition, the indication, such as a control signal, may be generated to the elevator service unit 219. Preferably, the generated indication may be transmitted to the elevator service unit 219 in real time. In response to receiving the indication the elevator service unit 219 may be configured to instruct maintenance personnel to inspect the condition of the elevator car suspension means 210 and/or to replace the elevator car suspension means 210 with a new elevator car suspension means. This enables a condition-based maintenance. Alternatively or in addition, the indication or may be for example a visual indication or sound indication for a service or maintenance personnel to inspect the condition of the elevator car suspension means 210 and/or to replace the elevator car suspension means 210 with a new elevator car suspension means.

Figure 8:
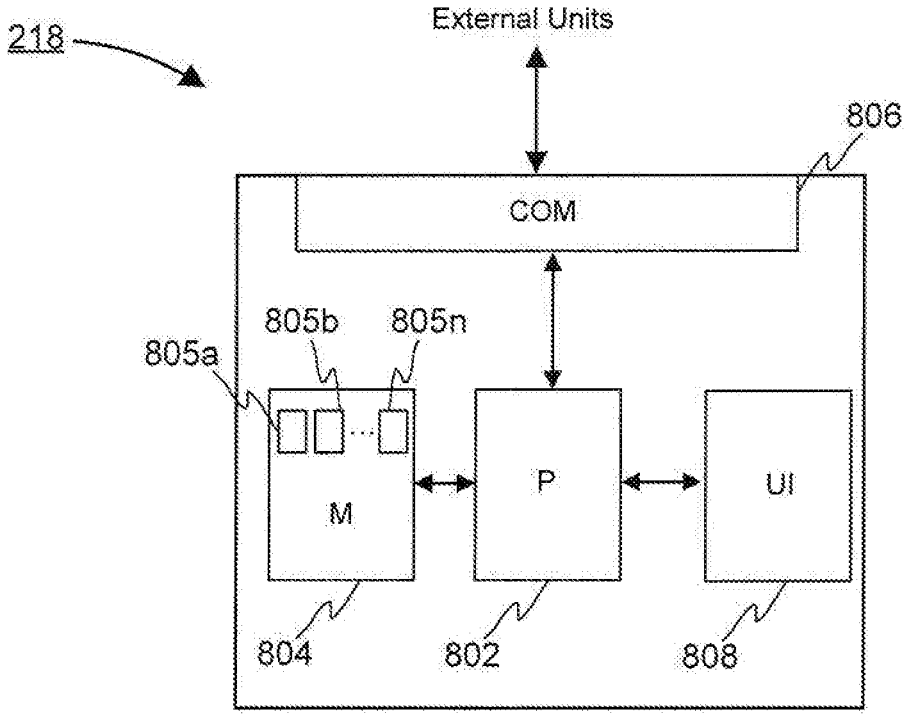
FIG. 8 illustrates schematically an example of an elevator safety control unit according to the invention.

FIG. 8 illustrates schematically an example of an elevator safety control unit 218 according to the invention. The elevator safety control unit 218 may comprise at least one processor 802, at least one memory 804, a communication interface 806, and one or more user interfaces 808. The at least one processor 802 may be any suitable for processing information and control the operation of the elevator safety control unit 218, among other tasks. The at least one processor 802 of the elevator safety unit 218 is at least configured to implement at least some method steps as described above. The at least one processor 802 of the elevator safety control unit 218 is thus arranged to access the at least one memory 804 and retrieve and store any information therefrom and thereto. The operations may also be implemented with a microcontroller solution with embedded software. The at least one memory 804 may be volatile or non-volatile. Moreover, the at least one memory 804 may be configured to store portions of computer program code 805*a*-805*n* and any data values. The at least one memory 804 is not limited to a certain type of memory only, but any memory type suitable for storing the described pieces of information may be applied in the context of the present invention. The communication interface 806 provides interface for communication with any external unit, such as with the elevator control unit 214, the elevator service unit 219 and/or any external systems. The communication interface 806 may be based on one or more known communication technologies, either wired or wireless, in order to exchange pieces of information as described earlier. The mentioned elements of the elevator safety unit 218 may be communicatively coupled to each other with e.g. an internal bus.

Figure 9:
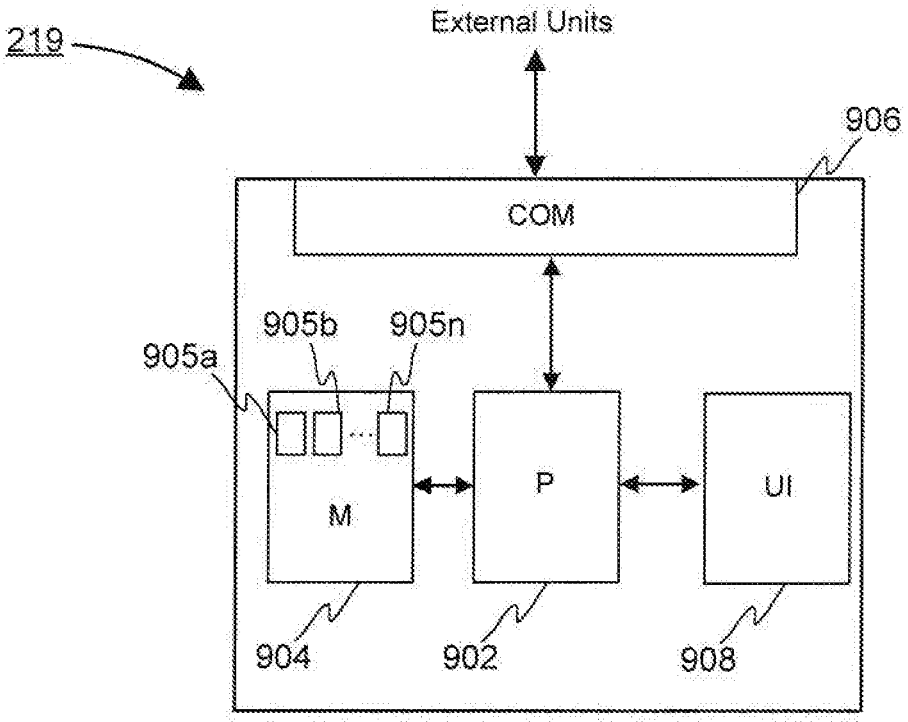
FIG. 9 illustrates schematically an example of an elevator service unit according to the invention.

FIG. 9 illustrates schematically an example of an elevator service unit 219 according to the invention. The elevator service unit 219 may comprise at least one processor 902, at least one memory 904, a communication interface 906, and one or more user interfaces 908. The at least one processor 902 may be any suitable for processing information and control the operation of the elevator service unit 219, among other tasks. The at least one processor 902 of the service unit 219 is at least configured to implement at least some method steps as described above. The at least one processor 902 of the elevator service unit 219 is thus arranged to access the at least one memory 904 and retrieve and store any information therefrom and thereto. The operations may also be implemented with a microcontroller solution with embedded software. The at least one memory 904 may be volatile or non-volatile. Moreover, the at least one memory 904 may be configured to store portions of computer program code 905*a*-905*n* and any data values. The at least one memory 904 is not limited to a certain type of memory only, but any memory type suitable for storing the described pieces of information may be applied in the context of the present invention. The communication interface 906 provides interface for communication with any external unit, such as with the elevator control unit 214, the elevator safety control unit 218 and/or any external systems. The communication interface 906 may be based on one or more known communication technologies, either wired or wireless, in order to exchange pieces of information as described earlier. The user interface 908 may be configured to input control commands, receive information, and/or instructions, and to display information. The user interface 908 may comprise at least one of the following: at least one function key, touchscreen, keyboard, mouse, pen, display, printer, speaker. The mentioned elements of the elevator service 219 may be communicatively coupled to each other with e.g. an internal bus.

The present invention as hereby described provides great advantages over the prior art solutions. For example, the present invention improves at least partly the safety of the elevators. Furthermore, the present invention enables an automated method for a condition-based maintenance. Alternatively or in addition the present invention enables an automated method for defining the condition of the elevator car suspension means. This also allows that the monitoring of a condition of the elevator car suspension means may be performed remotely, which in turn improves at least partly the availability of the elevators, because less maintenance breaks for performing condition inspections for the elevator car suspension means are needed. Furthermore, the present invention enables defining the condition of a coated rope or a belt. Moreover, at least some embodiments of the present invention enables implementation of defining the condition of the elevator car suspension means by using already existing components of the elevator system. Thus, additional expensive components are not needed. The use of already existing components of the elevator system 200 that meet good Safety Integrity Level (SIL) accuracy requirements enables that the condition of the elevator car suspension means may be defined so that good SIL accuracy requirements are met. SIL may be used to indicate a tolerable failure rate of a particular safety function, for example a safety component. SIL is defined as a relative level of risk-reduction provided by the safety function, or to specify a target level of risk reduction. SIL has a number scheme from 1 to 4 to represent its levels. The higher the SIL level is, the greater the impact of a failure is and the lower the failure rate that is acceptable is.

The term "normal operation" of an elevator is used in this patent application to mean the operation of the elevator, wherein the elevator car is configured to drive in the elevator shaft between floors in order to serve passengers and/or to carry loads. The normal operation of the elevator covers also the time periods, when the elevator car is configured to wait at a floor an instruction to move to another floor.

The term "door zone" is used in this patent application to mean a zone extending from a lower limit below floor level to an upper limit above the floor level in which a landing door and an elevator car door are in mesh and operable. The door zone may be determined to be from −400 mm to +400 mm for example. Preferably, the door zone may be from −150 mm to +150 mm. When arriving to the door zone the elevator car is allowed to begin to open the doors even before the elevator car is stopped.

The verb "meet" in context of a limit is used in this patent application to mean that a predefined condition is fulfilled. For example, the predefined condition may be that the limit for allowed change is reached and/or exceeded.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A method for defining a condition of an elevator car suspension means, wherein the method comprises detecting a rate of change of elongation of the elevator car suspension means in order to define the condition of the elevator car suspension means wherein the method comprising:

obtaining periodically a value representing an overtravel distance of an elevator car resulting from the elongation of the elevator car suspension means, defining a change value representing a rate of change of the overtravel distance of the elevator car as a function of time based on the periodically obtained values representing the overtravel distance of the elevator car resulting from the elongation of the elevator car suspension means, and generating, in response to a detection that the change value meets a limit for allowed change, an indication representing a change of the condition of the elevator car suspension means, the indication including an instruction to take the elevator car out of service and/or to replace the elevator car suspension means with a new elevator car suspension means; and wherein the limit for the allowed change value is defined based on previously defined overtravel distance rate of change values.

2. An elevator safety control unit for defining a condition of an elevator car suspension means, the elevator safety control unit comprising:

at least one processor, and at least one memory storing at least one portion of computer program code, wherein the at least one processor being configured to cause the elevator safety control unit at least to detect a rate of change of elongation of the elevator car suspension means in order to define the condition of the elevator car suspension means, wherein the elevator safety control unit is further configured to:

obtain periodically a value representing an overtravel distance of an elevator car resulting from the elongation of the elevator car suspension means, define a change value representing a rate of change of the overtravel distance of the elevator car as a function of time based on the periodically obtained values representing the overtravel distance of the elevator car resulting from the elongation of the elevator car suspension means, and generate, in response to a detection that the change value meets a limit for allowed change, an indication representing a change of the condition of the elevator car suspension means, the indication including an instruction to take the elevator car out of service and/or to replace the elevator car suspension means with a new elevator car suspension means, wherein the limit for the allowed change value is defined based on previously defined overtravel distance rate of change values.

3. An elevator system for defining a condition of an elevator car suspension means, the elevator system comprising:

an elevator car, the elevator car suspension means for carrying the elevator car, and an elevator safety control unit, wherein the safety control unit is configured to detect a rate of change of elongation of the elevator car suspension means in order to define the condition of the elevator car suspension means, wherein the elevator system further comprises an elevator service unit, wherein the elevator safety control unit is configured to:

obtain periodically a value representing an overtravel distance of the elevator car resulting from the elongation of the elevator car suspension means, and wherein the elevator safety control unit or the elevator service unit is configured to:

define a change value representing a rate of change of the overtravel distance of the elevator car as a function of time based on the periodically obtained values representing the overtravel distance of the elevator car resulting from the elongation of the elevator car suspension means, and wherein the elevator safety control unit or the elevator service unit is configured to:

generate, in response to a detection that the change value meets a limit for allowed change, an indication representing a change of the condition of the elevator car suspension means, wherein the limit for the allowed change is defined based on previously defined overtravel distance rate of change values.

* * * * *